US007677404B2

(12) United States Patent
McEldowney et al.

(10) Patent No.: US 7,677,404 B2
(45) Date of Patent: Mar. 16, 2010

(54) TAB, TOOLING FOR THE MANUFACTURE OF THE TAB AND METHOD OF MANUFACTURING THE TAB

(75) Inventors: Craig Allen McEldowney, Russia, OH (US); Mark Richard Mitchell, Sidney, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 504 days.

(21) Appl. No.: 11/643,300

(22) Filed: Dec. 21, 2006

(65) Prior Publication Data

US 2008/0078764 A1 Apr. 3, 2008

Related U.S. Application Data

(60) Provisional application No. 60/848,687, filed on Oct. 2, 2006.

(51) Int. Cl.
*B65D 17/34* (2006.01)

(52) U.S. Cl. ..... 220/269; 220/272; 220/273; 413/12; 413/14

(58) Field of Classification Search ..... 220/269, 220/273, 272, 622, 692, 270, 271; 413/12, 413/14; 24/94; 138/159; 411/501; 470/27
See application file for complete search history.

(56) References Cited

U.S. PATENT DOCUMENTS 3,425,591 A 2/1969 Pugh, Sr.
3,606,076 A 9/1971 Hanke et al.
3,715,051 A 2/1973 Hanke
3,795,342 A 3/1974 Ashton
4,576,305 A 3/1986 Saunders
4,596,342 A 6/1986 Zysset
4,681,238 A * 7/1987 Sanchez ..... 220/260
2004/0099665 A1 * 5/2004 McEldowney et al. ..... 220/270

* cited by examiner

*Primary Examiner*—Anthony Stashick
*Assistant Examiner*—Jeffrey Allen
(74) *Attorney, Agent, or Firm*—Eckert Seamans Cherin & Mellott, LLC; Grant E. Coffield, Esquire

(57) ABSTRACT

The invention generally relates to a tab used to open food can ends and beer/beverage can ends. The tab has a nose portion located at a front end of the tab and a lift portion located at a back end of the tab. The tab also has a rivet receiving portion located proximate to the nose portion with a rivet hole. The rivet receiving portion is coupled to the nose portion. The rivet hole has a non-round perimeter with a first diameter portion and a second diameter portion. The first diameter portion has a plurality of first arcuate segments and the second diameter portion has a plurality of notches. The second diameter portion is greater in length than the first diameter portion. Tooling for the manufacture of the tab is also provided. A method for manufacturing the tab is additionally provided as well.

18 Claims, 7 Drawing Sheets

TAB, TOOLING FOR THE MANUFACTURE OF THE TAB AND METHOD OF MANUFACTURING THE TAB

PARENT CASE TEXT

This patent application claims priority under 35 USC §119 (e)(1) to provisional patent application No. 60/848,687, filed Oct. 2, 2006, the contents of which is hereby incorporated by reference into this patent application in its entirety as if fully set forth herein.

FIELD OF THE INVENTION

The invention generally relates to a tab used to open food can ends and beer/beverage can ends, tooling for the manufacture of the tab and a method of manufacturing the tab.

BACKGROUND OF THE INVENTION

A tab is typically secured to a can end and the can end is opened by lifting a lift portion of the tab by pulling upwards on the tab so as to pivot the tab about a rivet which secures the tab to the can end. Lifting the lift portion of the tab upwards fractures a score line disposed on the can end which permits the end-user to access the contents of the can end.

Canmakers desire to maintain a nose of the tab by the score line of the can end in order to allow for the proper fracture of the score line by the nose of the tab to enable the end-user to access the contents of the can end. A problem that exists with tabs is that tabs can rotate relative to the can end. Such rotational movement of the tab could allow the tab to be rotated too far which causes a situation in which the can end cannot be opened by an end-user because of incorrect alignment of the nose of the tab relative to the score line of the can end.

Accordingly, a need exists in the art for a tab, tooling for the manufacture of the tab and a method for the manufacture of the tab that provides the tab with rotational resistance relative to the can end in order to maintain the nose of the tab by the score line of the can end to permit the tab to fracture the score line and enable the end-user to access the contents of the can end.

SUMMARY OF THE INVENTION

An object of the invention is to provide a tab, tooling for the manufacture of the tab and a method for the manufacture of the tab that provides the tab with rotational resistance relative to the can end in order to maintain the nose of the tab by the score line of the can end to permit the tab to fracture the score line and enable the end-user to access the contents of the can end.

Certain objects of the invention are achieved by providing a tab to be affixed to a can end. The tab has a nose portion located at a front end of the tab and a lift portion located at a back end of the tab. The tab also has a rivet receiving portion located proximate to the nose portion with a rivet hole. The rivet receiving portion is coupled to the nose portion. The rivet hole has a non-round perimeter with a first diameter portion and a second diameter portion. The first diameter portion has a plurality of first arcuate segments and the second diameter portion has a plurality of notches. The second diameter portion is greater in length than the first diameter portion.

Other objects of the invention are achieved by providing tooling for the manufacture of a tab to be affixed to a can end. The tooling includes a rivet hole punch having a lower surface with a non-round perimeter that has a first diameter portion and a second diameter portion. The rivet hole punch is structured to form a rivet hole with a non-round perimeter. The tooling also includes a rivet die having a hole which is structured to receive sharpened edges located on the lower surface of the rivet hole punch. The rivet die has sharpened edges located about an upper surface of the rivet die proximate to an outer periphery of the hole. The first diameter portion has a plurality of first arcuate segments and the second diameter portion has a plurality of projections. The second diameter portion is greater in length than the first diameter portion.

Other objects of the invention are achieved by providing a method of manufacturing a tab to be affixed to a can end. The method comprises forming a rivet hole in a rivet receiving portion located proximate to a nose portion of the tab, the rivet hole having a non-round perimeter with a first diameter portion and a second diameter portion. The first diameter portion has a plurality of first arcuate segments and the second diameter portion has a plurality of notches. The second diameter portion is greater in length than the first diameter portion.

DETAILED DESCRIPTION OF THE PREFERRED EMBODIMENTS

Figure 1:
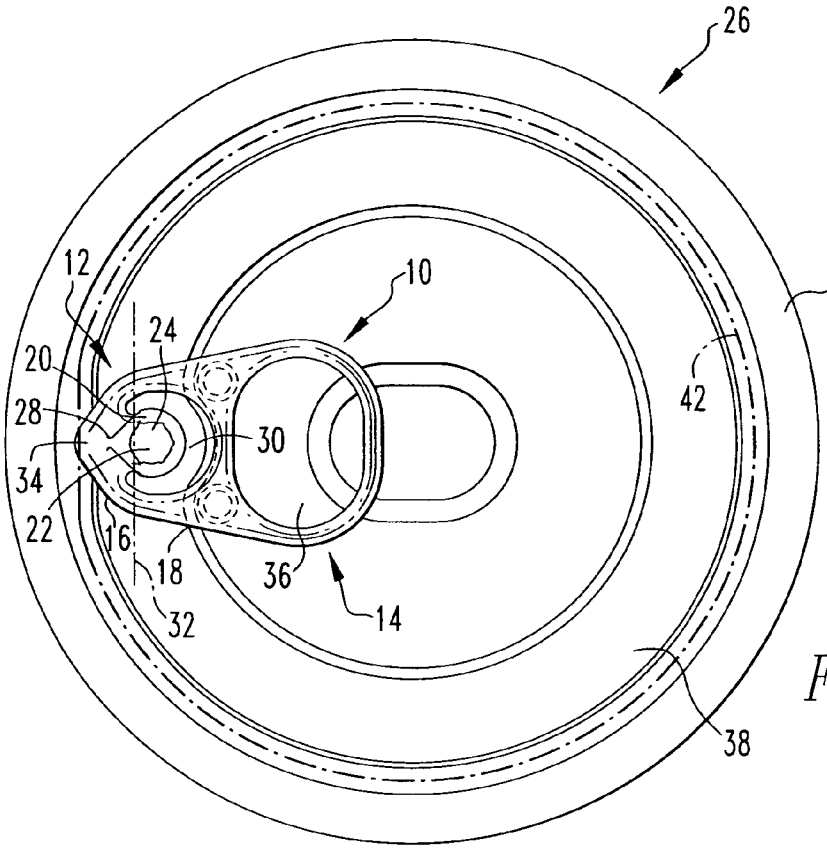
FIG. 1 is a top plan view of a tab affixed to a food can end.

For purposes of the description hereinafter, the terms "upper", "lower", "vertical", "horizontal", "axial", "top", "bottom", "aft", "behind", and derivatives thereof shall relate to the invention, as it is oriented in the drawing FIGS. However, it is to be understood that the invention may assume various alternative configurations except where expressly specified to the contrary. It is also to be understood that the specific elements illustrated in the FIGS. and described in the following specification are simply exemplary embodiments of the invention. Therefore, specific dimensions, orientations and other physical characteristics related to the embodiments disclosed herein are not to be considered limiting.

As used herein, the term "fastener" means any suitable fastening, connecting or tightening mechanism such as dowel pins, fasteners, rivets and the like. As used herein, the statement that two or more parts are "coupled" together means that the parts are joined together either directly or joined together indirectly through one or more intermediate parts. As used herein, the term "arcuate" means an elliptical or rounded: (i) arc; (ii) arch; (iii) bend; (iv) bow; (v) curve; (vi) radius; and (vii) the like that have one or more radii of curvatures. As used herein, the term "tab" means rigid material that has undergone one or more forming and/or tooling operations.

Figure 2:
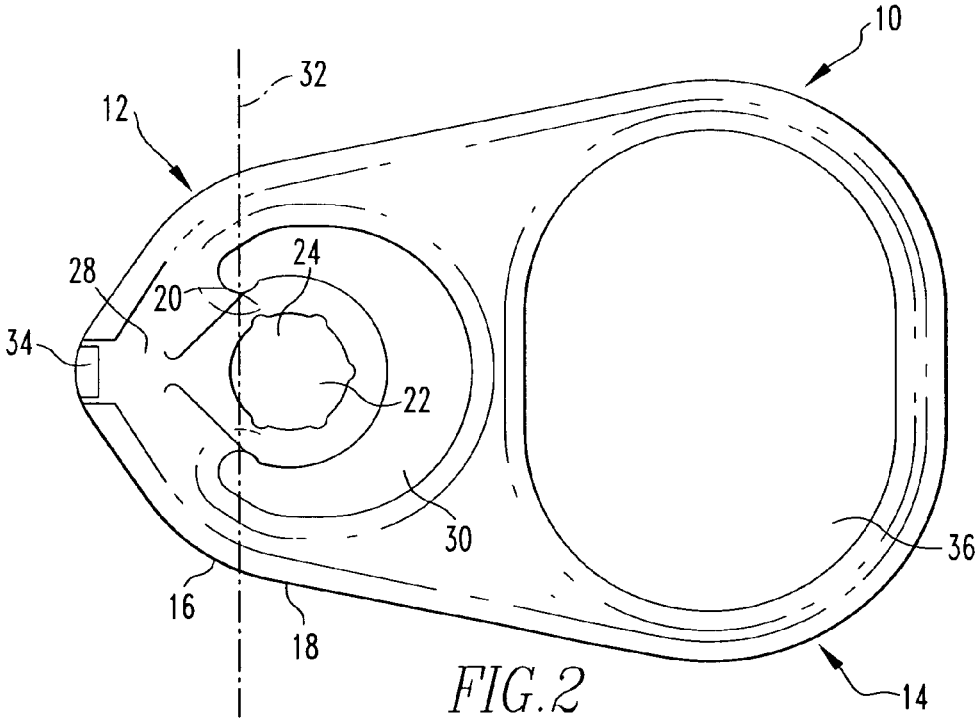
FIG. 2 is a top plan view of the tab shown in FIG. 1.

Turning to FIGS. 1-2, a tab 10 of the invention is shown. Tab 10 includes a nose portion 12 at a front end of tab 10 and a lift portion 14 at a back end of tab 10, wherein each portion is generally U-shaped along its periphery such that the two portions compliment each other to form a generally elliptical or oval shaped tab 10. Nose portion 12 and lift portion 14 may have curled or hemmed portions 16 located proximate to a peripheral surface 18 of the tab 10. The tab 10 has a rivet receiving portion 20 located proximate to the nose portion 12. The rivet receiving portion 20 has a rivet hole 22 and is attached to the nose portion 12 through a panel.

The rivet receiving portion 20 is a generally semi-circular shaped, square shaped or rectangular shaped panel located rearwardly of the nose portion 12 with a central rivet hole 22. The rivet hole 22 is shaped to receive an integral rivet 24 to affix the tab 10 to a can end 26 about which the nose portion 12 can pivot. The rivet receiving portion 20 is integrally attached to the nose portion 12 along a panel 28. A generally C-shaped slot 30 surrounds a portion of the outer periphery of the rivet receiving portion 20. The C-shaped slot 30 is an aperture that further facilitates flexibility of the tab 10 with the opposed ends of the C-shaped slot 30 defining a fulcrum 32. The fulcrum 32 allows the tab 10 to pivot upwards and downwards about the fulcrum 32.

V-shaped detent 34 is provided proximate to the panel 28. The V-shaped detent 34 reduces the requisite opening force needed to open the can end 26. Lift portion 14 is the part of the tab 10 actuated by an end-user to open the can end 26. The lift portion 14 is generally U-shaped with curled or hemmed portion 16 located along the peripheral surface 18 of the lift portion 14. The curled edges or hemmed portion 16 located proximate to the lift portion 14 are curled or hemmed underneath the lift portion 14. The lift portion 14 includes a finger hole 36 disposed through a surface of the lift portion 14 for user activation. While the finger hole 36 is shown as having the shape of an ellipse, one of skill in the art would appreciate that finger hole 36 could be in the shape of a circle, oval or other geometric shapes.

With reference to FIG. 1, the tab 10 of the invention is shown affixed to a standard can end 26 used in food applications. Can end 26 has an end panel 38 of generally circular shape which includes a circumferentially extending raised curl 40 for attaching the can end 26 to a suitable food can body (not shown) or the like. In general, the can end 26 will be manufactured of steel alloyed sheet or aluminum alloyed sheet.

The end panel 38 is defined by a score line 42 which surrounds the end panel 38 so the end panel 38 is removable from the can end 26 by an end-user when the score line 42 is fractured. The score line 42 is typically fractured by having the end-user grasp the lift portion 14 of the tab 10. The end-user then lifts the lift portion 14 upward which flexes the integral rivet 24 forward thereby causing the nose portion 12 and the V-shaped detent 34 to flex downward and fracture the score line 42. The end-user may then pull on the lift portion 14 to remove the end panel 38 from the remainder of the can end 26.

Figure 3:
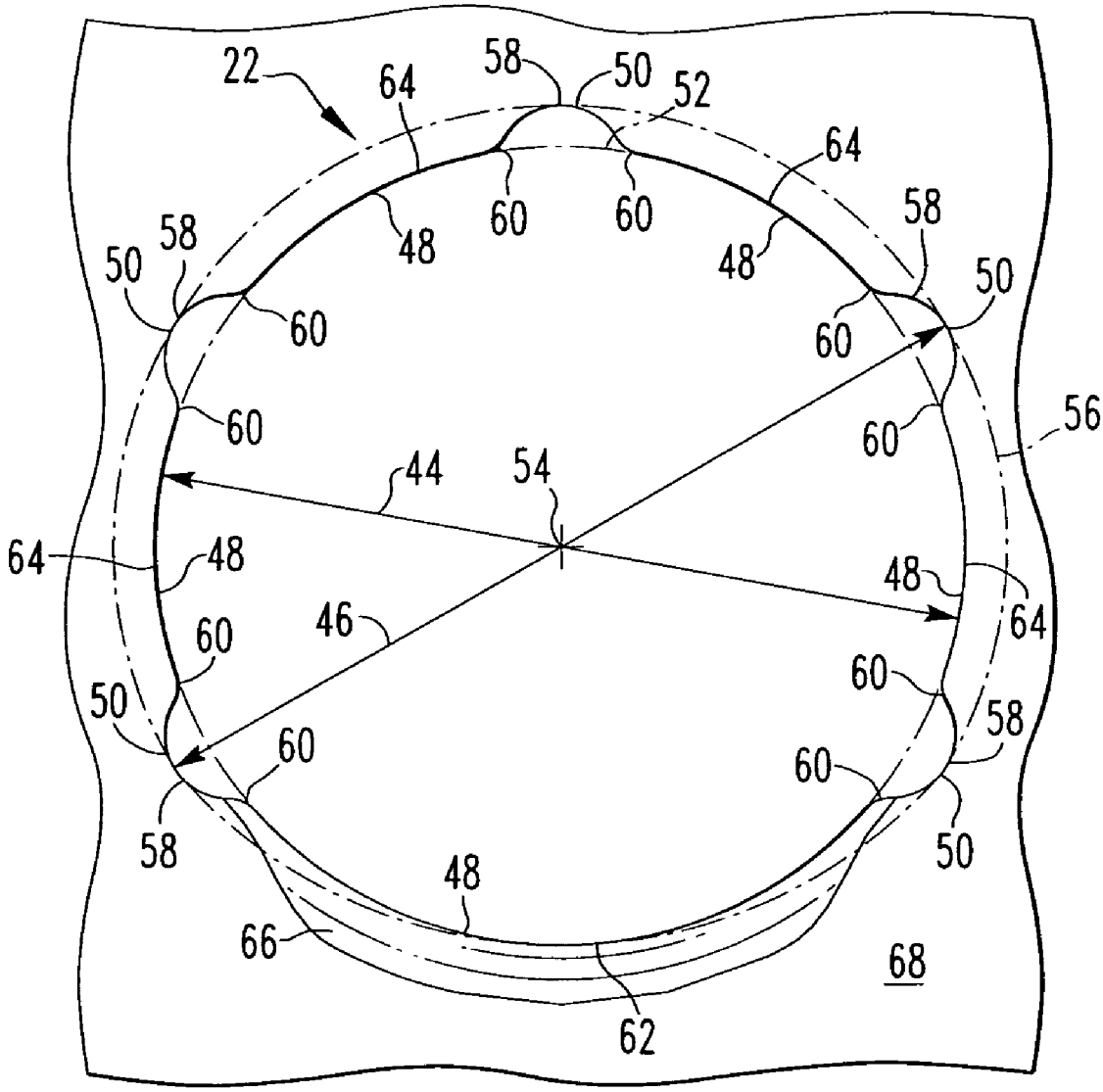
FIG. 3 is a bottom plan view of the rivet hole of the tab shown in FIG. 1.

As can be seen in FIG. 3, the rivet hole 22 has a non-round perimeter with a first diameter portion 44 and a second diameter portion 46. The first diameter portion 46 has a plurality of first arcuate segments 48 having a non-uniform arcuate size or curved length and the second diameter portion 46 has a plurality of notches 50. One or more of the plurality of first arcuate segments 48 may have an arcuate size or curved length which is greater than an arcuate size or curved length of at least one other of the plurality of first arcuate segments 48. The second diameter portion 46 is greater in length than the first diameter portion 44. Each of the notches 50 may have the general shape of an arcuate segment, a multi-sided geometric shape or combinations thereof. Examples of a multi-sided geometric shape include a triangle, rectangle, square, other multi-sided geometric shapes having three or more sides, etc.

A first circle or ellipse 52 may be drawn around the first diameter portion 44. Various other diameters may be drawn from a first arcuate segment 48 located on one side of the first circle or ellipse 52 through a center 54 of the rivet hole 22 to another first arcuate segment 48 located on the other side of the first circle or ellipse 52 which various other diameters may be of the same length or may be of different lengths. While FIG. 3 shows the first diameter portion 44 as having a single diameter, it is understood that the first diameter portion 44 may have any length of the various other diameters that may be drawn from a first arcuate segment 48 located on one side of the first circle or ellipse 52 through the center 54 of the rivet hole 22 to another first arcuate segment 48 located on the other side of the first circle or ellipse 52 which various other diameters may have the same length or may have different lengths.

A second circle or ellipse 56 may be drawn around the second diameter portion 46. Various other diameters may be drawn from an outer extent of a midpoint of a notch 50 located on one side of the second circle or ellipse 56 through the center 54 of the rivet hole 22 to the other side of the second circle or ellipse 56 which various other diameters may be of the same length or may be of different lengths. While FIG. 3 shows the second diameter portion 46 as having a single diameter, it is understood that the second diameter portion 46 is defined as having any length of the various other diameters that may be drawn from an outer extent of a midpoint of a notch 50 located on one side of the second circle or ellipse 56 through the center 54 of the rivet hole 22 to the other side of the second circle or ellipse 56 which various other diameters may have the same length or may have different lengths. As shown in FIG. 3, the second diameter portion 46 has a plurality of nodes or splines 58. While five nodes or splines 58 are shown in the drawings, any number of nodes or splines 58 may be used.

The center 54 of the rivet hole 22 has a focal point located approximately at the center 54 of the rivet hole 22 which faces the first diameter portion 44 and the second diameter portion 46. The first arcuate segments 48 and the notches 50 when the notches 50 comprise a plurality of second arcuate segments have a concave appearance from the focal point. A top plan view of the rivet hole 22 shows the rivet hole 22 as having a general appearance of being non-round, scalloped, splined or the like. The first arcuate segments 48 and the notches 50 are integrally connected together with connector segments 60 that may extend towards an inner area of the rivet hole 22. Each of the connector segments 60 may also have a tip portion which is structured to have an interference fit with the rivet 24 after being staked to the rivet 24. The tip portion may be sharp or radiused.

One of the first arcuate segments 62 located proximate to the nose portion 12 of the tab 10 has an arcuate size or curved length which is greater than an arcuate size or curved length of at least one other of the plurality of first arcuate segments 64. The one first arcuate segment 62 located proximate to the nose portion 12 of the tab 10 has a generally U-shaped depression 66 formed proximate thereto on a bottom surface 68 of the tab 10. The U-shaped depression 66 allows the tab 10 to slide relative to the rivet 24 and avoid damage to the rivet 24 during opening of the can end 26.

The rivet 24 has a base 70 (FIG. 11) and the first arcuate segments 48 and the notches 50 are integrally connected together with connector segments 60. At least one, some or all of the connector segments 60 have an interference fit with the rivet 24 after being staked to the rivet 24. Such interference would provide the tab 10 with resistance against rotation of the tab 10. Also, the staking of the tab 10 to the rivet 24 causes plastic deformation in the material of the rivet 24 which flows the material of the rivet 24 outwardly into a portion of a space supplied by the notches 50 and provides a certain amount of interference between the rivet 24 and the notches 50. Such interference between the rivet 24 and the notches 50 would provide the tab 10 with resistance against rotation of the tab 10. At least one, some or all of the first arcuate segments 48 are structured to have a clearance fit with the rivet 24 prior to being staked to the rivet 24. The connector segments 60 proximate to the lift portion 14 are structured to be further affixed to the base 70 of the rivet 24 when a rotational force is applied to the tab 10. Such further affixing would provide the tab 10 with resistance against further rotation of the tab 10.

Certain canmakers desire that a tab 10 coupled to a can end 26 resists rotation of the tab 10 relative to the can end 26. The rotational resistance of the tab 10 is desired to maintain the nose 12 of the tab 10 by the score line 42 of the can end 26 to allow for proper fracture of the score line 42 by the nose 12 of the tab 10 which enables an end-user to successfully remove the end panel 38 from the can end 26. Tabs that rotate relative to a can end have the potential of being rotated too far which causes a situation in which the can end cannot be opened by an end-user because of incorrect alignment of the nose of the tab relative to a score line of the can end.

In the tooling for the manufacture of the tab 10 of the invention and associated method, material to be converted into a plurality of tabs 10 is conveyed into a conversion press. In the typical operation of a conversion press, material is introduced between at least one upper tool member and at least one lower tool member that are in an open, spaced apart position. A ram advances the upper tool member toward a lower tool member in order to perform any of a variety of tooling operations such as rivet forming, hole punching, scoring, paneling, embossing and/or final staking. After performing an operation at a specific station, the press ram retracts until the upper tool member and lower tool member are once again in the open, spaced apart position. The partially converted material is transported to the next tooling station until the tab 10 is completely formed and discharged from the conversion press. As the material leaves a given tooling operation, more material is introduced to the vacated position, for example, as part of a continuous sheet, thus continuously repeating the manufacturing process.

Figure 4:
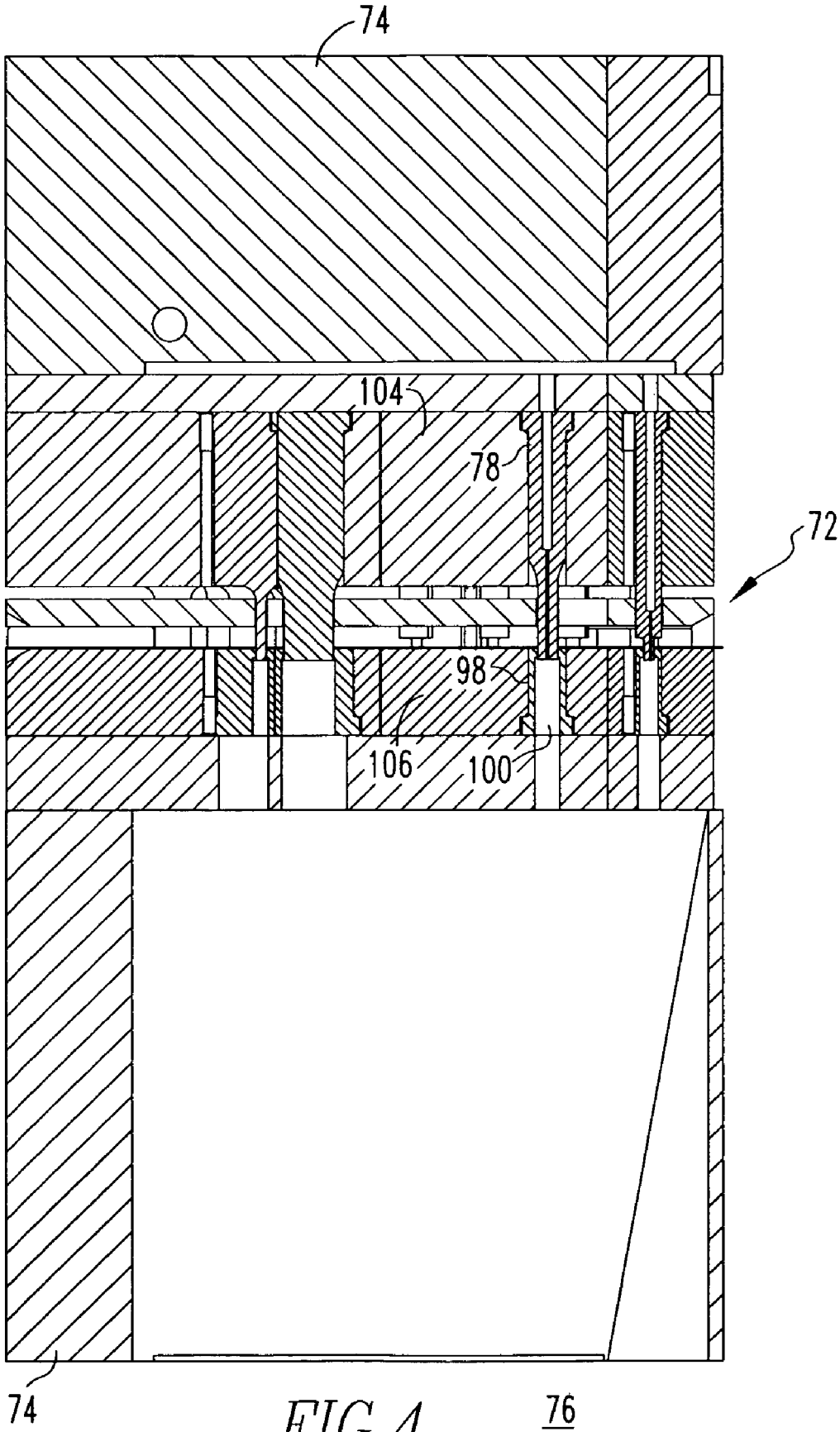
FIG. 4 is a side cross-sectional view of a tooling station in a conversion press which displays a rivet hole punch for forming rivet holes.
Figure 5:
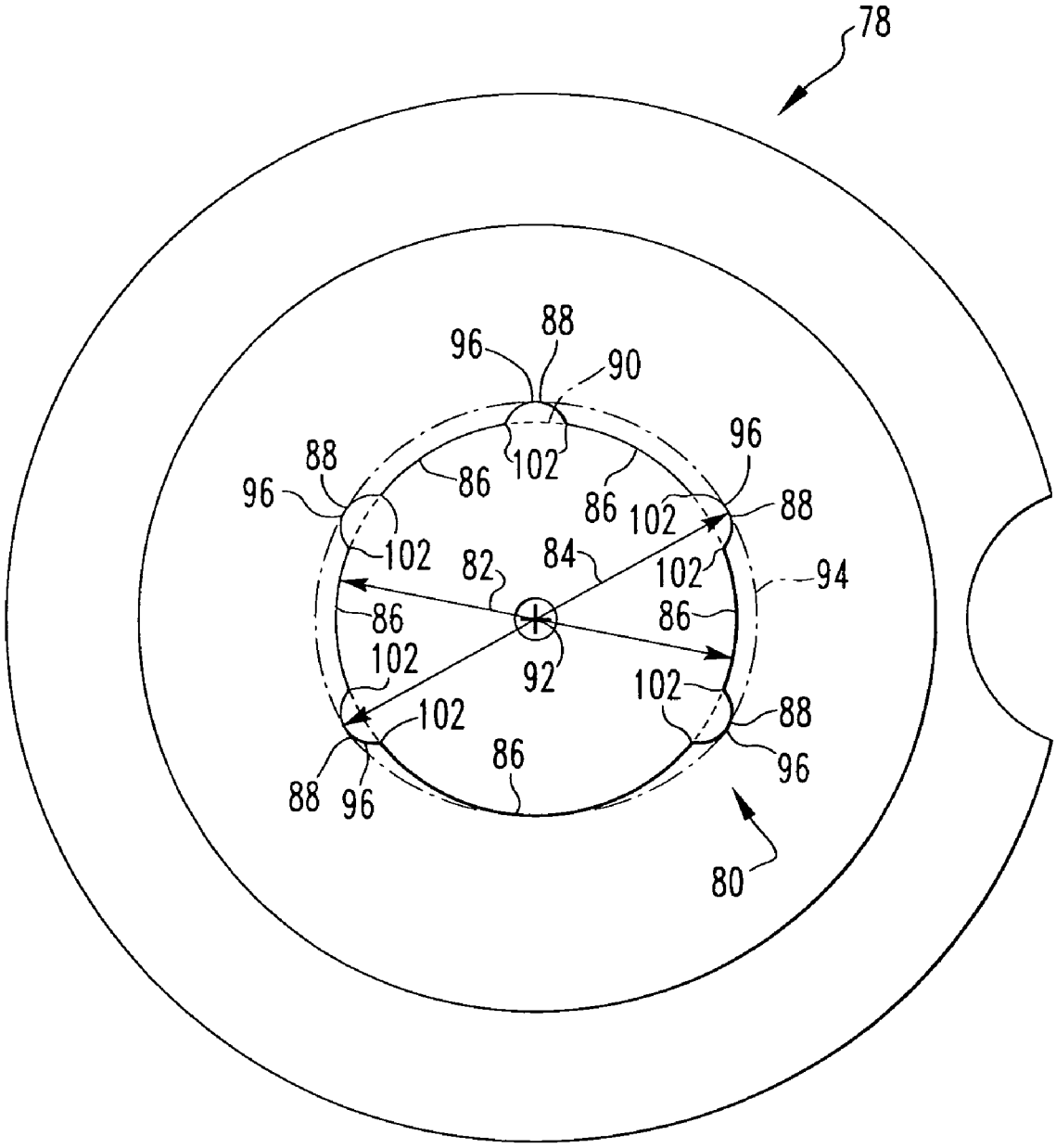
FIG. 5 is a bottom plan view of the rivet hole punch shown in FIG. 4.
Figure 12:
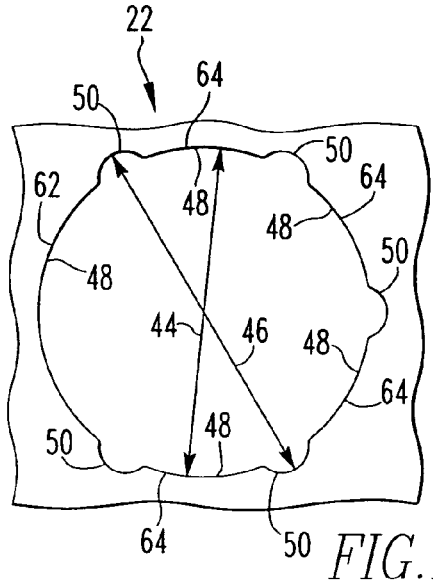
FIG. 12 is top plan view of the rivet hole of the tab after being formed with the rivet hole punch of FIG. 4.

Tooling 72 for the manufacture of the tab 10 is shown in FIGS. 4-11 and the appearance of the rivet hole 22 formed from a method for manufacturing the tab 10 of the invention is shown in FIGS. 3 and 12. As depicted in FIG. 4, tooling 72 of the invention is shown coupled to dies 74 coupled to a conversion press 76. A rivet hole punch 78 is shown in FIGS. 4-5 which has a lower surface 80 with a non-round perimeter that has a first diameter portion 82 and a second diameter portion 84. The rivet hole punch 78 is structured to form the rivet hole 22 with a non-round perimeter. The first diameter portion 82 has a plurality of first arcuate segments 86 having a non-uniform arcuate size or curved length and the second diameter portion 84 has a plurality of projections 88. One or more of the plurality of first arcuate segments 86 may have an arcuate size or curved length which is greater than an arcuate size or curved length of at least one other of the plurality of first arcuate segments 86 such as, for example, the first arcuate segment 86 which is structured to form the one first arcuate segment 62 proximate to the nose portion 12 of the tab 10. The second diameter portion 84 is greater in length than the first diameter portion 82. Each of the projections 88 may have the general shape of an arcuate segment, a multi-sided geometric shape or combinations thereof. Examples of a multi-sided geometric shape include a triangle, rectangle, square, other multi-sided geometric shapes having three or more sides, etc.

A first circle or ellipse 90 may be drawn around the first diameter portion 82. Various other diameters may be drawn from a first arcuate segment 86 located on one side of the first circle or ellipse 90 through a center 92 of the lower surface 80 of the rivet hole punch 78 to another first arcuate segment 86 located on the other side of the first circle or ellipse 80 which various other diameters may be of the same length or may be of different lengths. While FIG. 5 shows the first diameter portion 82 as having a single diameter, it is understood that the first diameter portion 82 may have any length of the various other diameters that may be drawn from a first arcuate segment 86 located on one side of the first circle or ellipse 90 through the center 92 of the lower surface 80 of the rivet hole punch 78 to another first arcuate segment 86 located on the other side of the first circle or ellipse 80 which various other diameters may have the same length or may have different lengths.

A second circle or ellipse 94 may be drawn around the second diameter portion 84. Various other diameters may be drawn from an outer extent of a midpoint of a projection 86 located on one side of the second circle or ellipse 94 through the center 92 of the lower surface 80 of the rivet hole punch 78 to the other side of the second circle or ellipse 94 which various other diameters may be of the same length or may be of different lengths. While FIG. 5 shows the second diameter portion 84 as having a single diameter, it is understood that the second diameter portion 84 is defined as having any length of the various other diameters that may be drawn from an outer extent of a midpoint of a projection 86 located on one side of the second circle or ellipse 94 through the center 92 of the lower surface 80 of the rivet hole punch 78 to the other side of the second circle or ellipse 94 which various other diameters may have the same length or may have different lengths. As shown in FIG. 5, the second diameter portion 84 has a plurality of nodes or splines 96. While five nodes or splines 96 are shown in the drawings, any number of nodes or splines 96 may be used.

A rivet die 98 having a hole 100 is provided in opposed relation to the rivet hole punch 78. The hole 100 is structured to receive sharpened edges located on the lower surface 80 of the rivet hole punch 78. The rivet die 98 has sharpened edges located about an upper surface of the rivet die 98 proximate to an outer periphery of the hole 100.

The lower surface 80 of the rivet hole punch 78 has a center 92 and a focal point located approximately at the center 92 of the lower surface 80 which faces the first diameter portion 82 and the second diameter portion 84. The first arcuate segments 86 and the projections 88 when the projections 88 comprise a plurality of second arcuate segments have a concave appearance from the focal point. A bottom plan view of the lower surface 80 has a general appearance selected from the group consisting of non-round, scalloped and splined. The first arcuate segments 86 and the projections 88 are integrally connected together with connector segments 102 that may extend towards an inner area of the lower surface 80. The connector segments 102 may also have a tip portion that may be sharp or radiused.

The rivet hole punch 78 is structured to form at least one, some or all of a plurality of first arcuate segments 48 in a first diameter portion 44 of the rivet hole 22 and at least one, some or all of a plurality of notches 50 in the second diameter portion 46 with one of the first arcuate segments 48 to be formed being located proximate to a nose portion 12 of the tab 10. The one first arcuate segment 62 which is to be formed has an arcuate size or curved length which is greater than an arcuate size or curved length of at least one other of the plurality of first arcuate segments 64 to be formed in the tab 10. One of the plurality of first arcuate segments 86 has an arcuate size or curved length which is greater than an arcuate size or curved length of at least one other of the plurality of first arcuate segments 86. The enlarged first arcuate segment 86 is structured to form the one first arcuate segment 62 proximate to the nose portion 12 of the tab 10. A punch retainer 104 couples the rivet hole punch 78 to the conversion press 76 and a die retainer 106 couples the rivet die 98 to the conversion press 76 as well.

The forming steps or processes described below occur in this tooling station when the ram (not show) of the conversion press 76 begins to descend. The sharpened edges of the lower surface 80 of the rivet hole punch 78 cooperate with the sharpened edges of the hole 100 of the rivet die 98 to form, lance or pierce the tab 10 to form the rivet hole 22 having a non-round perimeter with the first diameter portion 44 and the second diameter portion 46. The first diameter portion 44 that is formed has the plurality of first arcuate segments 48 having a non-uniform arcuate size or curved length and the second diameter portion 46 that is formed has the plurality of notches 50. The second diameter portion 46 is greater in length than the first diameter portion 44. In certain embodiments, one of the first arcuate segments 62 located proximate to the nose portion 12 of the tab 10 that may be formed with the rivet hole punch 78 has an arcuate size which is greater than an arcuate size of at least one other of the plurality of first arcuate segments 64 that are formed with the rivet hole punch 78.

Next, the ram of the conversion press 76 begins to ascend once the forming step described above has been completed. When the ram ascends, the rivet hole punch 78 lifts upwardly away from the rivet hole 22 that was formed and the conversion press 76 moves the sheet of material that is being formed into the tab 10 to the next tooling station to perform the next tooling operation on the tab 10.

Figure 6:
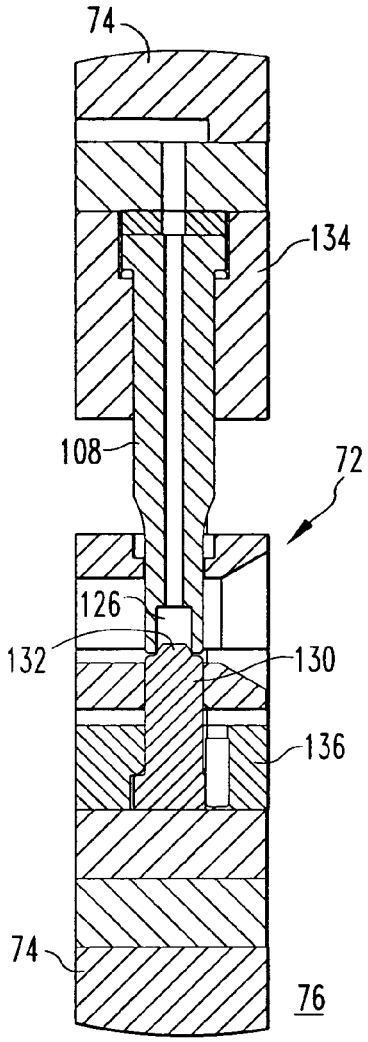
FIG. 6 is a side cross-sectional view of a tooling station in a conversion press which displays a rivet hole reform tool for reforming rivet holes.
Figure 7:
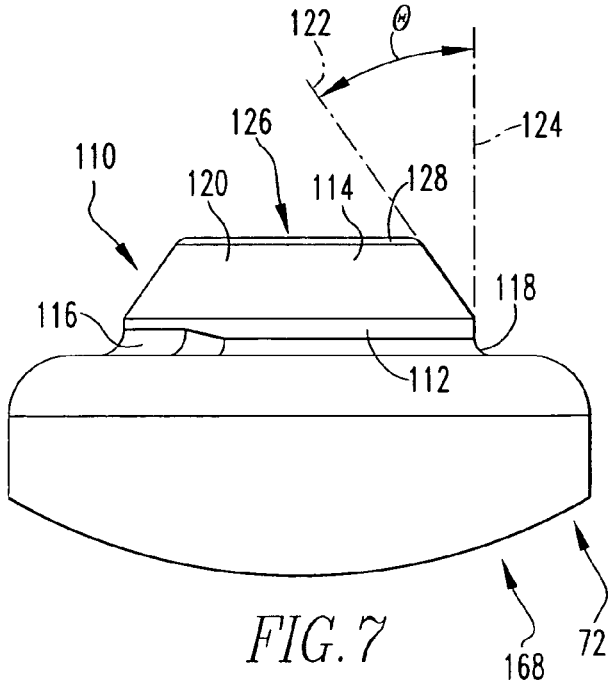
FIG. 7 is a side view of the rivet hole reform tool shown in FIG. 6.
Figure 8:
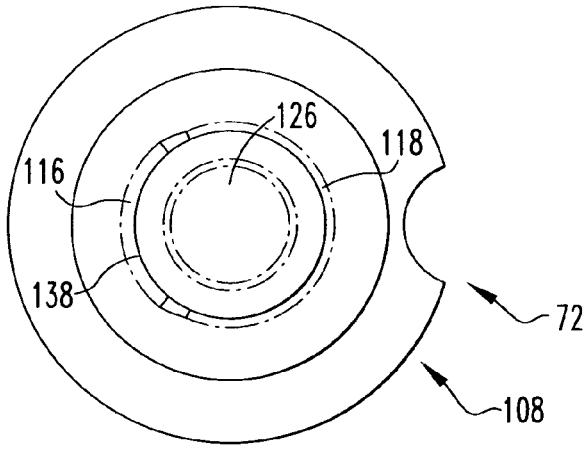
FIG. 8 is a bottom plan view of the rivet hole reform tool shown in FIG. 6.

With reference to FIGS. 6-8, the tooling 72 may also include a rivet hole reform tool 108 having a shank portion 110 having a first portion 112 and a second portion 114. The first portion 112 has a base 116 with a non-uniform radius or variable radius 118, the radius 118 being structured to reform the first diameter portion 44 and at least one of the first arcuate segments 48 of the rivet hole 22. The non-uniform radius 118 has a smaller radius of about 0.009 inches (0.23 mm) which is structured to reform the first diameter portion 44 proximate to the lift portion 14 of the tab 10 and has a radius larger than the smaller radius of about 0.014 inches (0.36 mm) which is structured to reform the first diameter portion 44 proximate to the nose portion 12 of the tab 10. The dimensions of the non-uniform radius 118 are exemplary and should not be considered as an express limitation of the invention. The second portion 114 has a tapered structure 120 extending from the first portion 112. The tapered structure 120 has a frusto-conical shape that extends along an axis of the tapered structure at an angle of about 30 degrees to about 40 degrees relative to an axis 124 that extends along the first portion 112. The rivet hole reform tool 108 also has an aperture 126 located within a lower surface 128 of the rivet hole reform tool 108.

A rivet reform die 130 having a shank portion 132 is provided in opposed relation to the rivet hole reform tool 108. The shank portion 132 is structured to cooperate with the base 116 of the rivet hole reform tool 108 in order to reform the first diameter portion 44. A portion of the shank portion 132 also extends into the aperture 126 during the process of reforming the first diameter portion 44. A retainer 134 couples the rivet hole reform tool 108 to the conversion press 76 and a retainer 136 couples the rivet reform die 130 to the conversion press 76 as well.

The forming steps or processes described below occur in this tooling station when the ram of the conversion press 76 begins to descend. The radius 118 is structured to reform the first diameter portion 44 and at least one of the first arcuate segments 48 of the rivet hole 22. Also, one first arcuate segment 62 of the at least one first arcuate segments 48 to be reformed is located proximate to a nose portion 12 of the tab 10. The one first arcuate segment 62 has an arcuate size which is greater than an arcuate size of at least one other of the plurality of first arcuate segments 64 formed in the tab 10. With reference to FIG. 8, a bottom plan view of a portion of the radius 118 shows that the radius 118 also has a general U-shape 138. The general U-shape 138 is structured to form a generally U-shaped depression 66 on the bottom surface 68 of the tab 10 proximate to the nose portion 12 of the tab 10. The generally U-shaped depression 66 is also located proximate to the one first arcuate segment 62 that has an arcuate size greater than an arcuate size of at least one other of the plurality of first arcuate segments 64 formed in the tab 10. See, FIG. 3 for a view of the general U-shaped depression 66 formed on the bottom surface of the tab 10. The U-shaped depression 66 allows the tab 10 to slide relative to the rivet 24 and avoid damage to the rivet 24 during opening of the can end 26.

Next, the ram of the conversion press 76 begins to ascend once the reforming step described above has been completed. When the ram ascends, the rivet hole reform tool 108 lifts upwardly away from the rivet hole 22 that was reformed and the conversion press 76 moves the sheet of material that is being formed into the tab 10 to the next tooling station to perform the next tooling operation on the tab 10.

Figure 9:
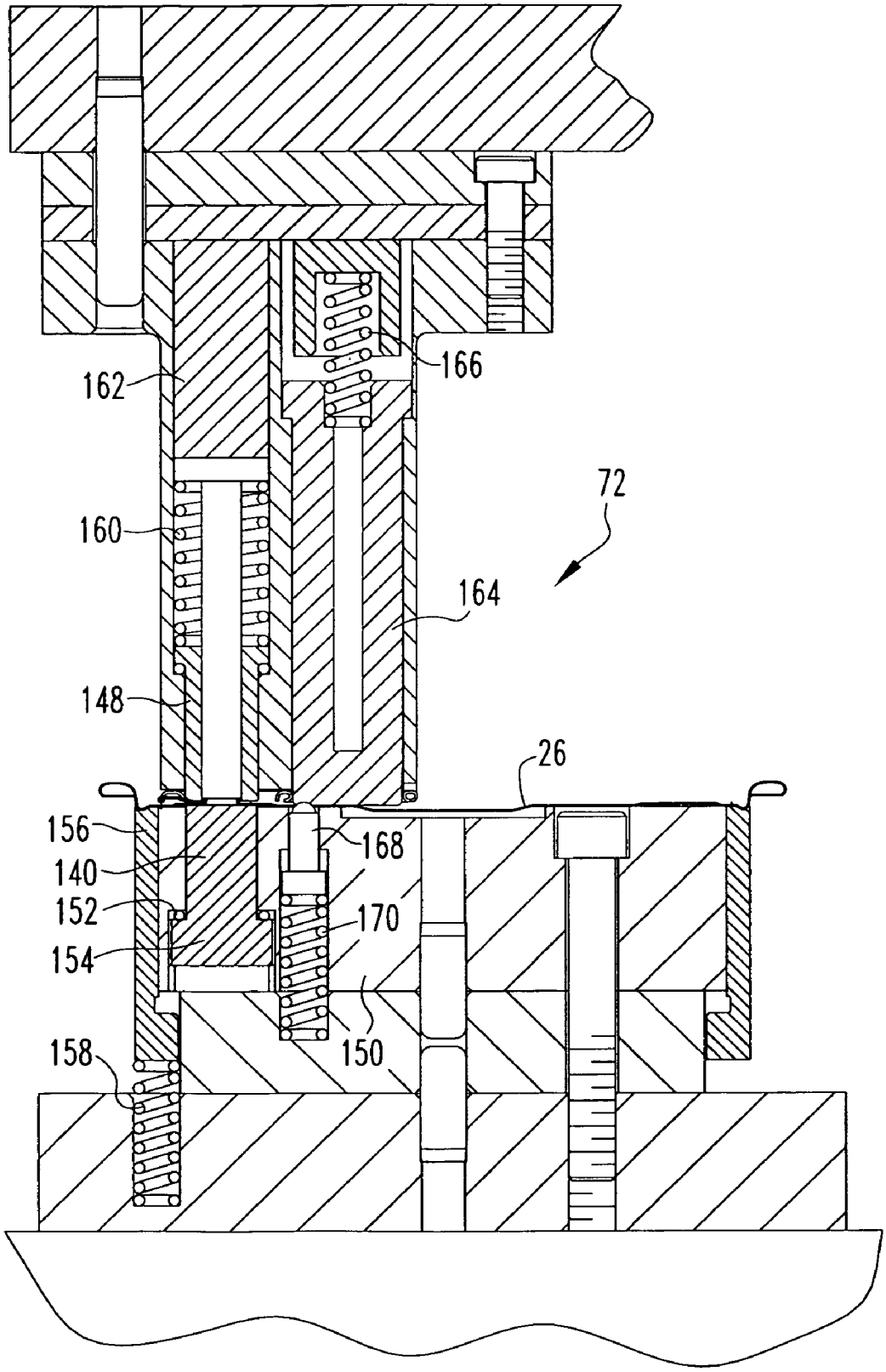
FIG. 9 is a side cross-sectional view of a tooling station in a conversion press which displays a lower stake tool and an upper stake punch for staking a tab on a can end.
Figure 10:
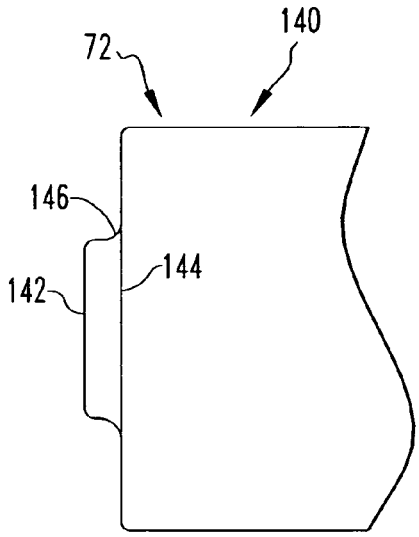
FIG. 10 is a side view of the lower stake tool shown in FIG. 9.
Figure 11:
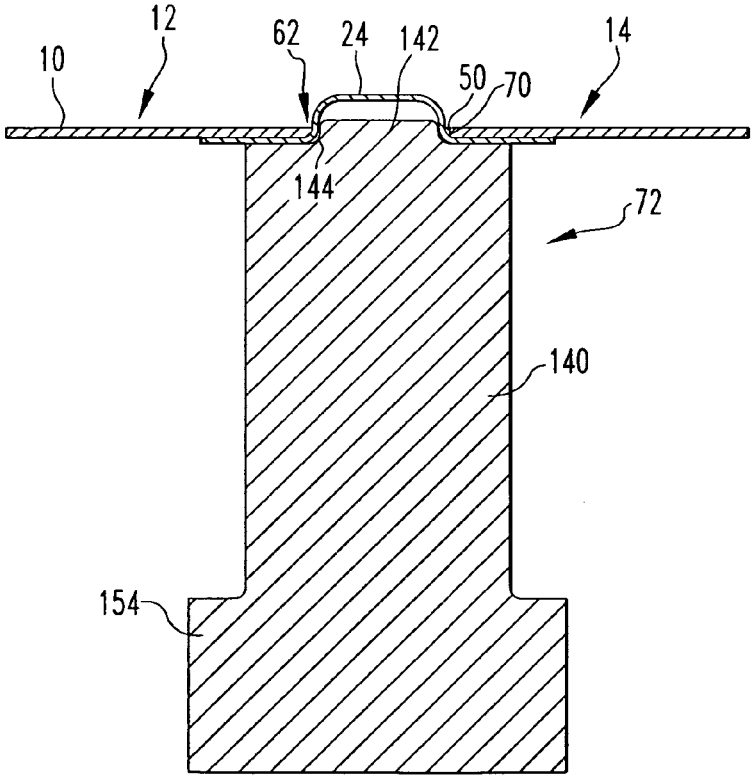
FIG. 11 is a side cross-sectional view of the lower stake tool of the type shown in FIG. 10 and a tab of the type shown in FIG. 2 positioned on a rivet prior to being staked to the rivet.

With reference to FIGS. 9-11, the tooling 72 may also include a lower stake tool 140. The lower stake tool 140 has a shank portion 142 with a base 144 having a non-uniform radius or variable radius 146 for supporting a rivet 24 having a radiused base portion structured to have a non-uniform radius formed therein with the lower stake tool 140. The non-uniform radius 146 has a smaller radius of about 0.015 inches (0.38 mm) which is structured to reform the rivet 24 proximate to the lift portion 14 of the tab 10 and has a radius larger than the smaller radius of about 0.020 inches (0.51 mm) which is structured to reform the rivet 24 proximate to the nose portion 12 of the tab 10. The dimensions of the non-uniform radius 146 are exemplary and should not be considered as an express limitation of the invention. The non-uniform radius 118 has a complementary shape to the non-uniform radius 146 to thereby provide a complementary shape to the rivet hole 22 and the rivet 24.

FIG. 9 illustrates the tooling 72 for the staking process. In the staking process, a tab 10 is positioned above the end panel 38 of the can end 26 so that the rivet 24 projects through the rivet hole 22. The downstroke of the ram of the conversion press 76 squeezes the top of the rivet 24 between an upper staking punch 148 and the lower stake tool 140. This squeezing action thins the metal in the top of the rivet 24 causing radially outward movement to create the rivet head, thus holding the tab 10 in place on the rivet 24.

As illustrated in FIG. 9, the lower stake tool 140 may be placed within an anvil 150 which couples the lower stake tool 140 to the conversion press 76. A resilient member 152 may be placed above a head 154 of the lower stake tool 140 in order to prevent an upper portion of the head 154 from contacting anvil 150 or to space the lower stake tool 140 from the upper staking punch 148. The anvil 150 provides support for the can end 26 in the area surrounding the rivet 24. The tooling 72 may also include a support member 156 which surrounds the anvil 150 and supports the periphery of the can end 26. Optionally, the support member 156 may be supported on a biasing member 158 as well to cushion any axial movement of the can end 26 during the staking process.

The upper staking punch 148 may include a biasing member 160 as well to cushion any axial movement of the upper staking punch 148 during the staking process. The biasing member 160 may also determine the degree to which the rivet 24 is flattened or squeezed outwardly in order to retain the tab 10 on the can end 26. A spacer 162 functions to assure that the upper staking punch 148 stakes the tab 10 to the can end 26. Additionally, the tooling 72 may be provided with a position dowel 164 which is designed to fit within the finger hole 36 of the tab 10. Likewise, the tooling 72 may be provided with another dowel 168 which is designed to support the can end 26. The dowel 164 is biased by a biasing member 166 and the dowel 168 is biased by a biasing member 170 so that the dowels 164 hold the tab 10 in position and the dowel 168 holds the can end 26 in position while the upper staking punch 148 flares the rivet 24 outwardly to secure the tab 10 to the can end 26. The can end 26 will be properly positioned once the rivet 24 projects through the rivet hole 22 of the tab 10 and the dowel 164 securely positions the tab 10.

In operation of the staking process, a can end 26 is inserted between the upper staking punch 148 and the lower stake tool 140 and a tab 10 is placed above the can end 26 with the rivet hole 22 of the tab 10 supported on the rivet 24. At least one, some or all of the first arcuate segments 48 are structured to have a clearance fit with the rivet 24 prior to being staked to the rivet 24. Also, one of the first arcuate segments 62 located proximate to the nose portion 12 of the tab 10 has an arcuate size which is greater than an arcuate size of at least one other of the plurality of first arcuate segments 64. At least one, some or all of the connector segments 60 are structured to have an interference fit with the rivet 24 after being staked to the rivet 24. Such interference would provide the tab 10 with resistance against rotation of the tab 10. The connector segments 60 proximate to the lift portion 14 are structured to be further affixed to the base of the rivet 24 when a rotational force is applied to the tab 10 which further affixing would provide the tab 10 with resistance against further rotation of the tab 10. As described above, certain technical benefits exist in providing a tab 10 coupled to a can end 26 that resists rotation of the tab 10 relative to the can end 26. To complete the staking process, the ram of the conversion press 76 forces the upper staking punch 148 down upon the can end 26. As the conversion press 76 advances to the closed position, the tab 10 is staked to the can end 26. The staking of the tab 10 to the rivet 24 causes plastic deformation in the material of the rivet 24 which flows the material of the rivet 24 outwardly into a portion of a space supplied by the notches 50 supplied by the notches 50 and provides a certain amount of interference between the rivet 24 and the notches 50. Such interference between the rivet 24 and the notches 50 would provide the tab 10 with resistance against rotation of the tab 10.

While FIGS. 4, 6 and 9 generally depict several tooling stations of a tab die in the conversion press 76, one of ordinary skill in the art would appreciate that many other tooling stations may be included in the tab die of the conversion press 76. While a limited number of tooling stations are included in the FIGS., the tooling 72 and the method of manufacturing the tab 10 of the invention can include numerous other tooling stations not depicted here which are known in the art. Those additional tooling stations and steps have been omitted from the FIGS. and specification for the purpose of simplifying the specification and FIGS. of the invention. Each tooling station includes one or more wear tools, wherein each of the wear tools perform a tooling operation on the material. Further, each of the stations can be housed in separate machine housings, in a single machine housing, or any combination thereof.

The material can be conveyed through the conversion press 76 by any means known in the art. Typically, material is fed into the conversion press 76 as sheets or is uncurled first and then fed into the conversion press 76 in sheets which is conveyed through the stations as a solid sheet until enough tooling operations have been performed on the material that separate tabs 10 are formed. Further, the material that manufactures tabs 10 is a relatively ductile metal such as, for example, aluminum alloyed sheet, but it may be made from other acceptable materials as required, such as, for example, steel alloyed sheet.

While the disclosure of FIG. 1 and the specification associated therewith is directed to a tab 10 structured to be affixed to a can end 26 used in food applications for the purpose of containing a food product or the like, the structure of the rivet hole 22, the rivet 24, the U-shaped depression 66, the tooling 72 and method of the invention could also be applied to other types of tabs that are structured, for example, to be affixed to beer can ends and beverage can ends. One of ordinary skill in the art would readily appreciate that the teachings of the invention would equally apply to tabs used in food applications as well as beer/beverage applications. As such, the structure of the rivet hole 22, the rivet 24, the U-shaped depression 66, the tooling 72 and method of the invention could be used with tabs that are affixed to food can ends, beer can ends, beverage can ends and other can ends. It is noted that the details of the structure of the rivet hole 22. the rivet 24, the U-shaped depression 66, the tooling 72 and method of the invention employed with tabs affixed to can ends other than food can ends have been omitted for the purpose of simplifying the specification and FIGS. of the invention.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A tab to be affixed to a can end, the tab comprising:

a nose portion located at a front end of the tab; a lift portion located at a back end of the tab; and a rivet receiving portion located proximate to the nose portion with a rivet hole, the rivet receiving portion being coupled to the nose portion, the rivet hole having a non-round perimeter with a first diameter portion and a second diameter portion, wherein the first diameter portion ends in a plurality of first arcuate segments on the non-round perimeter, wherein the second diameter portion ends in a plurality of notches on the non-round perimeter, wherein the second diameter portion is greater in length than the first diameter portion, wherein at least one of the first arcuate segments has an arcuate size which is different from an arcuate size of at least one other of the plurality of first arcuate segments, and wherein the rivet receiving portion is structured to resist rotation of the tab with respect to the can end.

2. The tab of claim 1, wherein the rivet hole has a center and a focal point located approximately at the center of the rivet hole which faces the first diameter portion and the second diameter portion, wherein the plurality of notches comprise a plurality of second arcuate segments, and wherein the first arcuate segments and the second arcuate segments have a concave appearance from the focal point.

3. The tab of claim 1, wherein a plan view of the rivet hole has a general appearance selected from the group consisting of non-round, scalloped and splined.

4. The tab of claim 1, wherein the first arcuate segments and the notches are integrally connected together with connector segments.

5. The tab of claim 1, wherein the at least one of the first arcuate segments is a single first arcuate segment located proximate to the nose portion of the tab; and wherein the single first arcuate segment has an arcuate size which is greater than the arcuate size of the other first arcuate segments.

6. The tab of claim 5, wherein the single first arcuate segment located proximate to the nose portion of the tab has a generally U-shaped depression formed proximate thereto on a bottom surface of the tab.

7. The tab of claim 1, further comprising a slot having opposed ends located proximate to the rivet hole surrounding a portion of an outer periphery of the rivet receiving portion, wherein the ends of the slot define a fulcrum, and wherein the fulcrum allows the lift portion to pivot about the fulcrum.

8. The tab of claim 7, wherein the slot is a generally C-shaped slot.

9. The tab of claim 1 in combination with a can end affixed to the tab with an integral rivet.

10. The combination of claim 9, wherein the rivet has a base, wherein the first arcuate segments and the notches are integrally connected together with connector segments, wherein at least one of the connector segments has an interference fit with the rivet after being staked to the rivet, wherein at least one of the first arcuate segments is structured to have a clearance fit with the rivet prior to being staked to the rivet, wherein staking of the tab to the rivet causes plastic deformation in the rivet which flows the rivet outwardly into a portion of a space provided by the notches to provide a certain amount of interference between the rivet and the notches in order to provide the tab with resistance against rotation of the tab, and wherein the connector segments proximate to the lift portion are structured to be further affixed to the base of the rivet when a rotational force is applied to the tab which further affixing would provide the tab with resistance against further rotation of the tab.

11. The combination of claim 9, wherein the can end is selected from the group consisting of food can ends, beer can ends and beverage can ends.

12. The tab of claim 1, further comprising a finger hole located in the lift portion of the tab.

13. A method of manufacturing a tab to be affixed to a can end, the method comprising: forming a rivet hole in a rivet receiving portion located proximate to a nose portion of the tab, the rivet hole having a non-round perimeter with a first diameter portion and a second diameter portion, wherein the first diameter portion ends in a plurality of first arcuate segments on the non-round perimeter, wherein the second diameter portion ends in a plurality of notches on the non-round perimeter, wherein the second diameter portion is greater in length than the first diameter portion, wherein at least one of the first arcuate segments has an arcuate size which is different from an arcuate size of at least one other of the plurality of first arcuate segments, and wherein the rivet receiving portion is structured to resist rotation of the tab with respect to the can end.

14. The method of claim 13, wherein the rivet hole has a center and a focal point located approximately at the center of the rivet hole which faces the first diameter portion and the second diameter portion, wherein the plurality of notches comprise a plurality of second arcuate segments, and wherein the first arcuate segments and the second arcuate segments have a concave appearance from the focal point.

15. The method of claim 13, wherein a plan view of the rivet hole has a general appearance selected from the group consisting of non-round, scalloped and splined.

16. The method of claim 13, wherein the first arcuate segments and the notches are integrally connected together with connector segments.

17. The method of claim 13, wherein the at least one of the first arcuate segments is a single first arcuate segment located proximate to the nose portion of the tab; and wherein the single first arcuate segment has an arcuate size which is greater than the arcuate size of the other first arcuate segments.

18. The method of claim 13, further comprising forming a generally U-shaped depression on a bottom surface of the tab proximate to the nose portion of the tab.

* * * * *

UNITED STATES PATENT AND TRADEMARK OFFICE

CERTIFICATE OF CORRECTION

PATENT NO. : 7,677,404 B2
APPLICATION NO. : 11/643300
DATED : March 16, 2010
INVENTOR(S) : Craig Allen McEldowney and Mark Richard Mitchell It is certified that error appears in the above-identified patent and that said Letters Patent is hereby corrected as shown below:

Column 7, line 33, "show" should be --shown--.
Column 10, line 5, please delete the words "supplied by the notches 50".

Signed and Sealed this

Eleventh Day of May, 2010

David J. Kappos

David J. Kappos
*Director of the United States Patent and Trademark Office*